US005220318A

United States Patent [19]

Staley

[11] Patent Number: 5,220,318

[45] Date of Patent: Jun. 15, 1993

[54] APPARATUS FOR SELECTIVELY VARYING KEYBOARD SWITCHING FORCE

[75] Inventor: Darrell S. Staley, Santa Clara, Calif.

[73] Assignee: Ampex Corporation, Calif.

[21] Appl. No.: 570,072

[22] Filed: Aug. 20, 1990

Related U.S. Application Data

[63] Continuation-in-part of Ser. No. 288,507, Dec. 22, 1988, abandoned.

[51] Int. Cl.[5] ..... B41J 5/26

[52] U.S. Cl. ..... 340/825.34; 400/481; 400/490; 400/491.2; 400/495

[58] Field of Search ..... 341/34, 32; 84/DIG. 7; 335/126, 131; 400/477, 479.2, 480, 481, 490, 495, 495.1, 491.2; 178/17 C, 101; 200/5 A; 361/187, 191, 144

[56] References Cited

U.S. PATENT DOCUMENTS

| | | | |
|---|---|---|---|
| 3,363,717 | 1/1968 | Hunt . | |
| 3,648,117 | 3/1972 | Yamamoto | 341/32 |
| 3,693,123 | 9/1972 | Pederson | 400/479.2 |
| 3,818,369 | 6/1974 | Brocker | 341/32 |
| 3,831,730 | 9/1974 | Koeppe | 400/481 |
| 3,938,042 | 2/1976 | Van Rumpt et al. | 400/480 |
| 4,028,696 | 6/1977 | Madland et al. | 341/32 |
| 4,494,109 | 1/1985 | Bernin | 400/479.2 |
| 4,507,601 | 3/1985 | Anderson | 341/32 |

*Primary Examiner*—Donald J. Yusko
*Assistant Examiner*—Brian Zimmerman
*Attorney, Agent, or Firm*—Harry G. Thibault; Douglas M. Gilbert; Richard C. Liu

[57] ABSTRACT

Apparatus for adjusting the key activating force or "touch" for a keyboard or for one or more function key groups on that keyboard to the needs of any individual operator.

5 Claims, 2 Drawing Sheets

APPARATUS FOR SELECTIVELY VARYING KEYBOARD SWITCHING FORCE

CROSS REFERENCE TO RELATED APPLICATIONS

This application is a continuation-in-part of application Ser. No. 07/288507 filed on Dec. 22, 1988 now abandoned.

BACKGROUND OF THE INVENTION

1. Field of the Invention

The present invention relates to keyboards, and in particular to apparatus for selectively varying the force required to activate the keypad assemblies which make up the keyboard.

2. Description of the Prior Art

Typically the finger-applied force necessary to activate one keypad assembly of a keyboard is the same as the force necessary to activate each of the other keypad assemblies in the keyboard. Users have commonly designated the force necessary to activate the keypad assemblies which make up the array as "touch". Typically "touch" for a keyboard, refers to a single and uniform input force applied to each keypad assembly of the array. However "touch", as defined above, differs greatly from the subjective needs of individual operators, each of whom may require a different "touch" to maximize their efficiency on the same keyboard.

The earliest keyboards were mechanical typewriter keyboards. Users activated individual keys by operating separable mechanical linkages in which a first linkage moved the key against the bias of a spring and successive linkages drove the print head into a ribbon which engaged a paper for imprinting. The spring retained the key in the inactive position. Furthermore, in all mechanical keyboards "touch" was defined only in terms of operator input, but variations in the force applied to the keys by fingers of the operator caused visible differences in the typed output, form word to word, form letter to letter.

Typically electronic keyboards are directed toward replacing certain of the mechanical linkages of early keyboards with electrical and electronic interfaces to thereby transfer from the operator to the keyboard the factor of "touch" thus to minimize the variations in typed output described above. The focus of keyboard improvements today has resided in the production of a uniform typed output, with emphasis on a uniform "touch". For example, U.S. Pat. No. 4,494,109 is directed to varying resistance to movement of the keypad assemblies of the array for the operator's benefit by changing the depth of penetration required to activate a switch to alter "touch". It uses a single circuit to control both keystroke output force and operator "touch".

However, a typewriter keyboard is far different from a multi-function computer keyboard. The computer keyboard provides not only a traditional typewriter keyboard array, but also an array of function keys, a cursor key array, and even a calculator keyset, to serve not only the word processor but also the accountant, the scientist, the engineer. Because different users have different needs, "touch" is best addressed if a direct input can selectively and independently vary the force required to activate the individual keypad assemblies of the array. A multi-function computer keyboard would employ a different "touch" for each separate function of such keyboard, to better enable the user to differentiate between such functions, and additional circuitry would be required for each of the functional key groupings of the keyboard. Alternatively it would be particularly advantageous to be able to selectively and continuously adjust the touch of individual keys so that certain keys, such as the delete or remove key(s), could be given a harder or stiffer touch than the other alpha-numeric keys.

SUMMARY OF THE INVENTION

Accordingly the circuitry contemplated by the present invention provides a new and particularly advantageous solution to the problem of "touch" in any keyboard and has further advantages when used in a multi-function keyboard.

In one aspect the present invention, each switch assembly of a keyboard includes power receiving portions connected to a power input section which delivers power to the power receiving portions, the power input section being adjustable to control the magnitude of input power to the power receiving portions. Any change in the input of power to the power input section translates directly to a change in resistance to movement of a keypad assembly associated with the power receiving portions, i.e., the "touch" of the associated keys. Although a keyboard structure can be configured to key each power input section of the structure into a single power supply to enable the user of the keyboard to alter its "touch" with a single adjustment, it is desirable in a multi-function keyboard to provide additional power input sections and additional circuitry in order to enable the user to individually control "touch" for each of the functional key groupings of the keyboard.

Other features and advantages of the present invention will become more apparent from the following detailed description, taken in conjuction with the accompanying drawings which illustrate, by way of example, the principles of the invention.

DETAILED DESCRIPTION OF THE INVENTION

Figure 1:
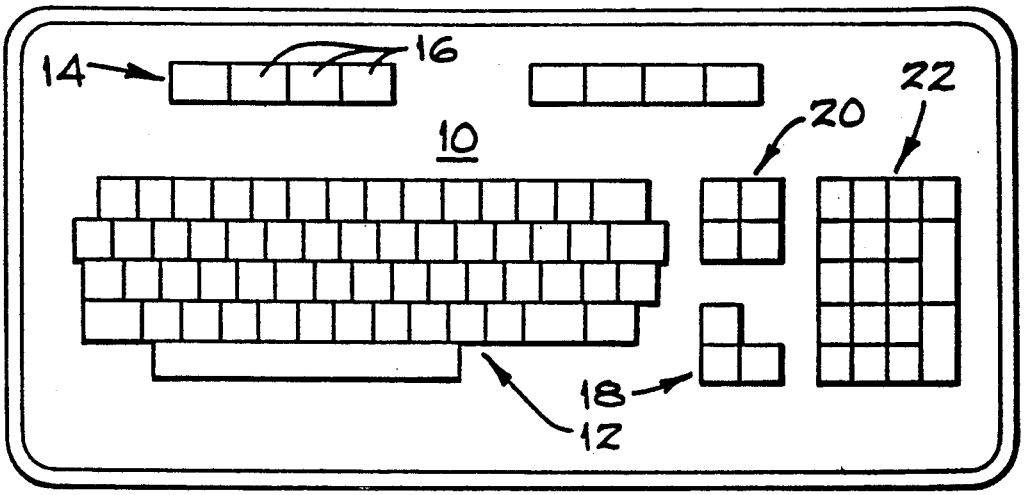
FIG. 1 is a plan view of a multi-function keyboard which employs the adjustable control apparatus of the present invention.

As shown in FIG. 1, a multi-function keyboard 10, typically used with a computer terminal (not shown), includes not only the typewriter keyboard 12 but also a row 14 of function keys 16, as well as other useful key groupings, such as a cluster 18 of keys controlling cursor movement, another cluster 20 of control keys, and a calculator key set 22.

Figure 2:
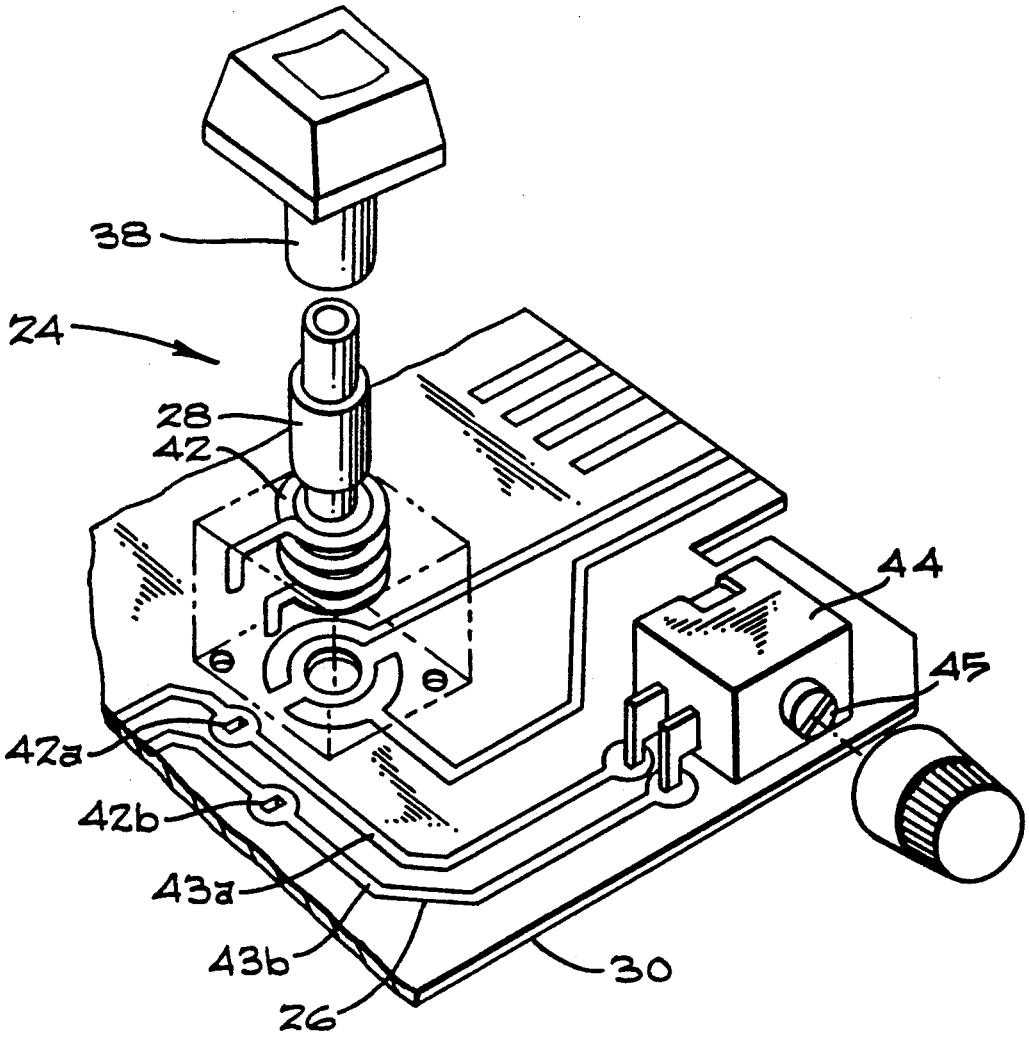
FIG. 2 is an exploded perspective view of a single switch assembly from the keyboard of FIG. 1 isolated for clarity.
Figure 3:
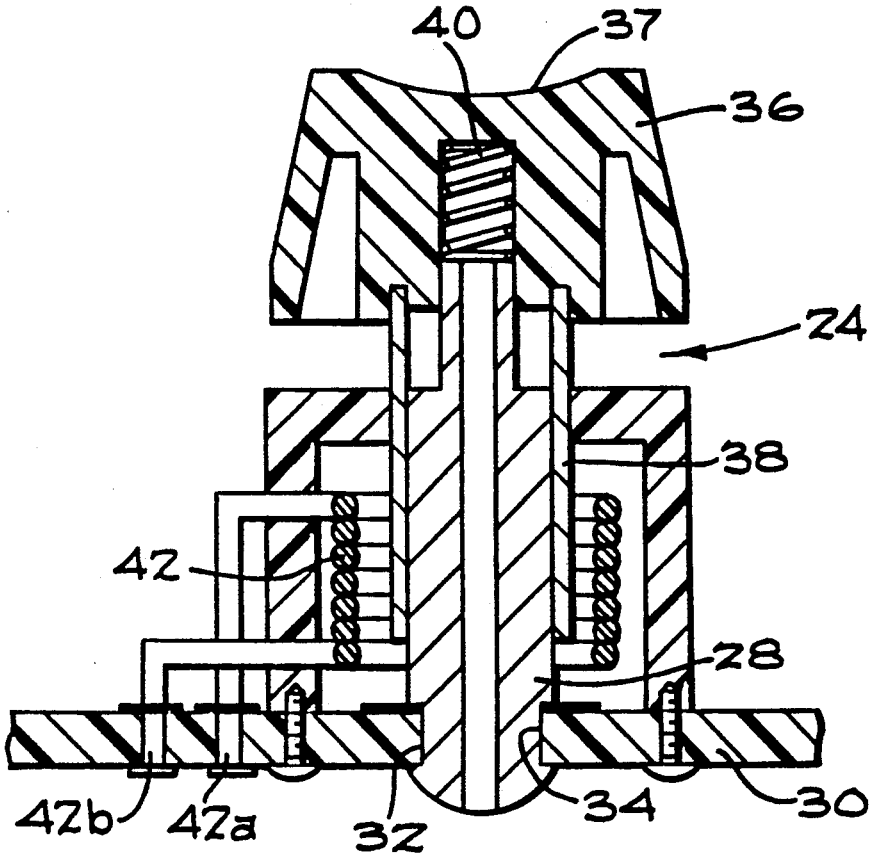
FIG. 3 is a vertical section of the switch assembly of FIG. 2 depicting portions of the adjustable control apparatus of the present invention.

In FIGS. 2 and 3, a single switch assembly 24 of the keyboard 10 has been isolated with a "touch" control apparatus 26 of the present invention to simplify an explanation of the invention. The switch assembly 24 includes a cylindrical switch body 28 mounted in a printed circuit board 30 for limited translatory movement along an axis generally perpendicular to the circuit board 30. In the preferred embodiment, a cylindrical recess 32 in the switch body 28 is received in a corresponding opening 34 in circuit board 30 to support switch assembly 24 for movement relative to the pc board 30. Overlying the switch body 28 is a cap 36 comprising an upper keypad 37 and a cylindrical sleeve 38 slideable onto and over the switch body 28. The sleeve 38 is formed of a magnetically permeable material. A coil spring 40, between keypad 37 and the upper end (as viewed) of switch body 28, applies a biasing force to switch assembly 24 toward a first, inactive position and exerts a predetermined resistance against the depression of keypad 37 and sleeve 38 downward toward circuit board 30 to a second, active position.

As is best seen in FIG. 2, surrounding the switch assembly 24 is a power input coil 42 generally coaxially aligned with the sleeve 38. A switch body support member 41 shown in FIG. 3 encloses the assembly 24 and supports the upper portion of the switch body 28 for axial movement transversely of the plane of board 30. Opposite ends 42*a*, 42*b* of the wire forming coil 42 are suitably connected to power lines 43*a*, 43*b*, respectively, provided on pc board 30 and which connect to an infinitely variable power supply 44. A potentiometer adjustment screw 45, provided on one face of the power supply 44, enables a user to vary the current through the coil 42 and in turn the magnitude of the electromagnetic field created by the coil 42. A force proportional to the magnitude of the magnetic field and in a downward direction, as viewed, is exerted on sleeve 38. Thus, this force attracts or pulls switch assembly downwardly in opposition to the constant bias force exerted by spring 40. In normal operation, the bias or compression force of spring 40 is always greater than the pulling force exerted by coil 42 and variation of the magnitude of the latter effectively changes the operator's key depressing force or "touch".

Although it is usually considered desirable that a single adjustable power supply 44 controls all of the switch assemblies 24 of the keyboard 10, in a multifunction keyboard 10, an operator may wish to assign a separate and different "touch" to different keyboard functions. Such an operator requirement is readily accommodated by the proposed apparatus, by assigning separate power supplies 44 to each of the key groups noted above.

Modifications and improvements to the control apparatus described herein are believed apparent to those skilled in the art. Accordingly, no limitation on the invention is intended by the description or drawing herein, except as set forth in the appended claims.

What is claimed is:

1. A keyboard array including a plurality of switch assemblies, each switch assembly comprising a switch body, a member supporting the switch body to accommodate movement between first and second spatial positions, and apparatus for controlling the amount of force necessary to cause one of said switch assemblies to move from the first to the second spatial positions, said apparatus comprising:

spring means positioned between the switch body and the supporting member for exerting a first biasing force against the switch body toward said first position;

magnetic permeable means on the switch body;

a multi-turn coil for generating a magnetic field aligned to exert on said magnetic permeable means a second biasing force opposing said first biasing force; and power means for supplying an electrical current to said coil for generating said magnetic field to selectively vary said second biasing force, thereby controlling the amount of force necessary to cause the energized switch assembly to move from the first to the second spatial position.

2. A keyboard array including a plurality of switch assemblies, each switch assembly comprising a switch body, a member supporting the switch body to accommodate spatial movement between first and second spatial positions, and apparatus for selectively controlling the amount of force required by one of said switch assemblies to move from the first to the second spatial positions, said apparatus comprising:

spring means between the switch body and the supporting member and exerting a biasing force against the switch body toward said first position;

a magnetically permeable sleeve mounted on the switch body;

a multi-turn coil surrounding at least a portion of the sleeve, said coil when energized generating a magnetic field for exerting an attractive force on said sleeve opposing said biasing force; and power means for supplying an electrical current to said coil to energize same, said power means being operative to selectively vary said attractive force of said magnetic field.

3. A keyboard array including a plurality of switch assemblies, each switch assembly comprising a switch body, a member supporting the switch body for movement between first and second body positions, and apparatus to drive each of said switch assemblies from the first to the second body positions with equal force, said apparatus comprising:

spring means between the switch body and the supporting member and providing a first force against the switch body and biasing same toward said first position;

a magnetically permeable sleeve mounted on the switch body;

a single multi-turn coil surrounding at least a portion of each sleeve of the array, said coil being operative to generate a magnetic field; and at least one electrical power input assembly to supply an electrical signal to each coil to energize same, the magnetic field generated by each coil being interactive with the associated sleeve for generating a second force in a direction opposite to and of magnitude less than said first force, said second force being equal for each switch assembly, the power means being operative to selectively vary said second force and thereby correspondingly varying the effect of said first force of the spring.

4. A keyboard array including at least one cluster of switch assemblies, each switch assembly of the cluster comprising a switch body, a member supporting the switch body for movement between first and second body positions, and apparatus to drive each of said switch assemblies of the cluster from the first to the second second body positions, said apparatus comprising:

a spring between the switch body and the supporting member and providing a first force resisting movement of the switch body in a first direction from the second to the first positions, a magnetically permeable sleeve mounted on the switch body;

a single multi-turn coil surrounding at least a portion of each sleeve of the cluster, said coil when energized being operative to generate a magnetic field; and at least one electrical power input assembly to supply an electrical signal to each coil to energize same, the magnetic field generated by each coil being interactive with the associated sleeve for generating a second force in a direction opposite to and of magnitude less than said first force, said second force being equal for each switch assembly, the power means being operative to selectively vary said second force and thereby correspondingly varying the effect of said first force of the spring in resisting movement of the switch body from the first to the second body positions.

5. A keyboard array including a plurality of switch assemblies, each switch assembly comprising a switch body, a member supporting the switch body for movement along an axis generally perpendicular to the support member and between first and second relatively fixed body positions, a cap mounted on the switch body, biasing means between the support member and the cap to apply a bias force against the switch body to move same to the first body position, and apparatus to drive each of said switch assemblies from the first to the second body positions, said apparatus comprising:

a magnetically permeable sleeve mounted on the switch body;

a single multi-turn coil surrounding at least a portion of the sleeve, said coil when energized being operative to generate a magnetic field; and an electrical power input assembly to supply an electrical signal to the coil to energize same, the magnetic field generated by each coil being interactive with the associated sleeve and exerting a pull on same toward the second body position and thereby decreasing the bias force of the biasing means, the power means being operative to selectively vary the magnitude of said pull on the sleeve and thereby correspondingly to vary the effect of said bias force in resisting movement of the switch body from the first to the second body positions.

* * * * *